United States Patent [19]

Ward

[11] 3,971,904

[45] July 27, 1976

[54] SWITCH ASSEMBLY FOR GAS TAP ASSEMBLY HAVING CAM OPERATED LEAF SPRING CONTACTS AND SPLIT HOUSING CAM DETENT STOP

[75] Inventor: William Edward Ward, Clanfield, England

[73] Assignee: Illinois Tool Works Inc., Chicago, Ill.

[22] Filed: May 22, 1975

[21] Appl. No.: 580,084

Related U.S. Application Data

[63] Continuation-in-part of Ser. No. 517,270, Oct. 23, 1974, abandoned.

[30] Foreign Application Priority Data

Oct. 23, 1974 United Kingdom ..... 49303/74

[52] U.S. Cl. ..... 200/6 BB; 200/61.86; 200/153 LB; 200/303; 200/154

[51] Int. Cl.[2] ..... H01H 21/80; H01H 9/06

[58] Field of Search ..... 200/6 R, 6 B, 6 BA, 200/6 BB, 6 C, 61.86, 153 LB, 153 L, 154, 283, 284, 293, 294–296, 318–327, 336

[56] References Cited

UNITED STATES PATENTS

| | | | |
|---|---|---|---|
| 3,251,956 | 5/1966 | Rasor et al. | 200/6 B X |
| 3,310,642 | 3/1967 | Zeller | 200/6 B X |
| 3,497,643 | 2/1970 | Heath | 200/336 X |
| 3,501,608 | 3/1970 | Rulseh et al. | 200/283 |
| 3,502,835 | 3/1970 | Batcheller | 200/61.86 X |
| 3,637,962 | 1/1972 | Fiddler et al. | 200/61.86 |
| 3,792,206 | 2/1974 | Purdy | 200/6 B |

*Primary Examiner*—James R. Scott
*Attorney, Agent, or Firm*—Robert W. Beart; Glenn W. Bowen

[57] ABSTRACT

An ignition switch for the selective ignition of a gas tap assembly that is controlled by a rotatable gas tap spindle is disclosed. The switch has an aperture which receives the gas tap spindle. Opening and closing of the gas tap is achieved by rotation of the spindle. Rotation of the spindle causes rotation of a cam in the aperture of the switch to control the making and breaking of a pair of electrical contacts. The contacts have relatively thick terminal portions that are secured in the housing with their outer ends extending into openings which receive insulated sockets. The contact members are L-shaped and have relatively thin contact portions which are positioned so that one portion overlies the other and both of them overlie the rotatable cam.

8 Claims, 6 Drawing Figures

Fig. 2.
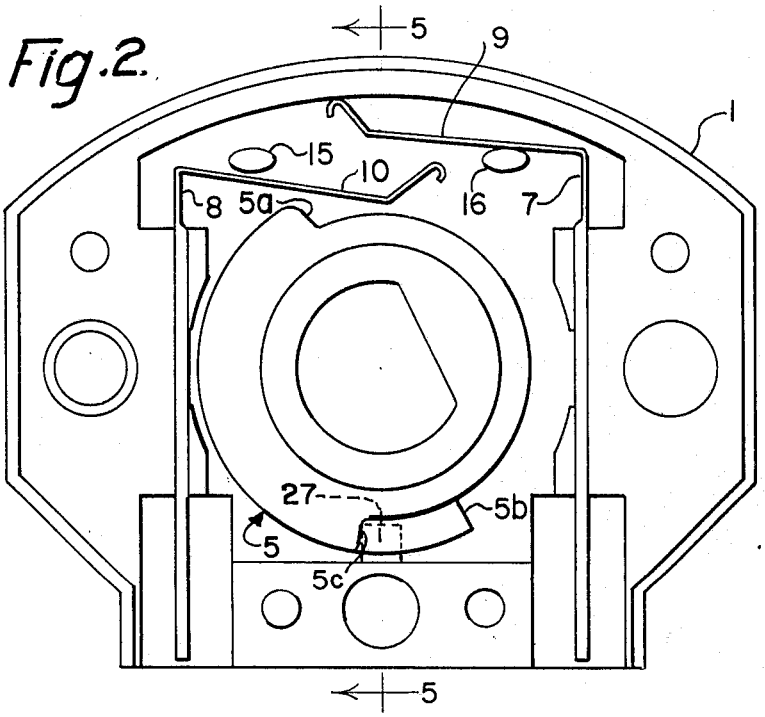
Fig. 5.
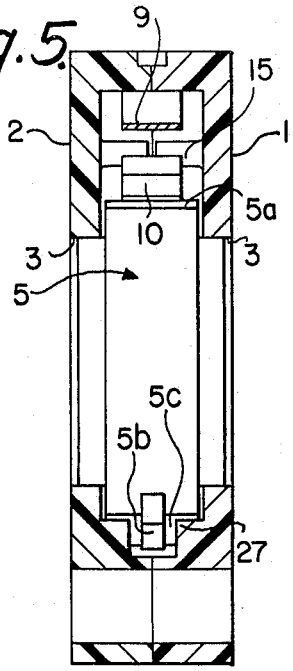
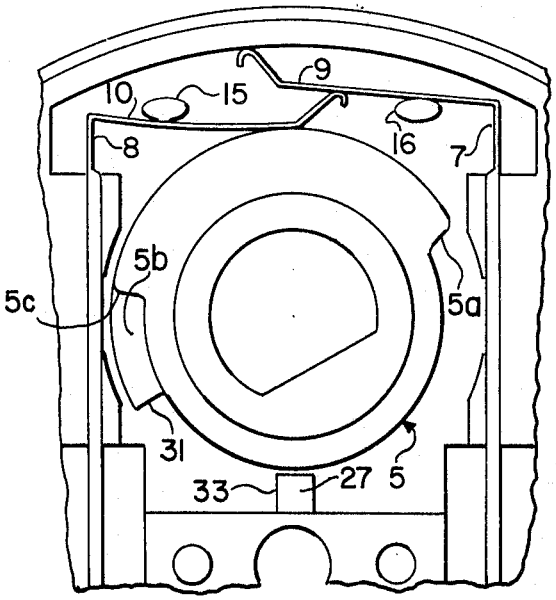
Fig. 3.
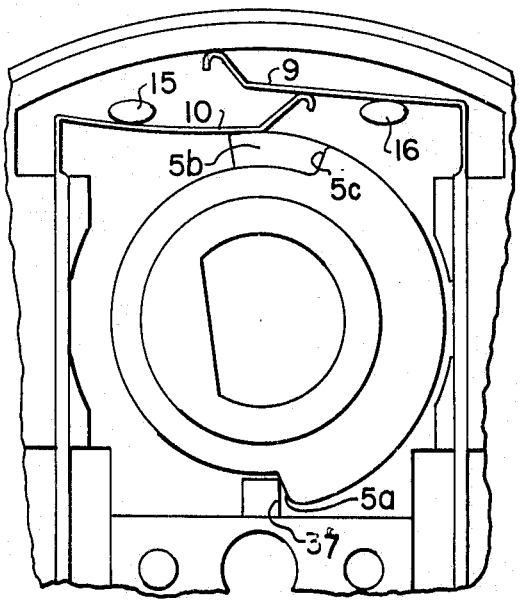
Fig. 4.

SWITCH ASSEMBLY FOR GAS TAP ASSEMBLY HAVING CAM OPERATED LEAF SPRING CONTACTS AND SPLIT HOUSING CAM DETENT STOP

This application is a continuation-in-part application of parent application Ser. No. 517,270 filed Oct. 23, 1974 now abandoned.

BACKGROUND OF THE INVENTION

This invention relates to electric switches and related more specifically to electric switches for use in gas cookers for operating gas reigniter circuits.

According to the present invention an electric switch comprises a plastic molded housing formed in two identical molded parts of shallow construction and arranged to be screwed or otherwise secured to an abutment surface through which the usual gas tap spindle extends, said housing having extending therethrough an opening in which a contact operating cam is positioned so that said spindle passes through the cam which is adapted to be rotated with said spindle, and switching contact members of preferably strip form are held captive within the switch housing by the cooperation between the housing parts and are positioned for actuation by said cam in response to rotation of said spindle.

The employment of two identical parts for the housing and the shallow form of these parts contributes both to low cost, compactness and ease of attachment to the usual gas tap assembly. Moreover, the switch contact members are securely held captive by the housing parts without the need for securing screws, etc., so that further savings in cost may be realized.

The strip contact members may be formed from milled strip of two different thicknesses so that the thinner flexible parts are used as the contact making parts while the thicker parts are used as rigid terminal parts.

To achieve good electrical insulation of the switch contact members, the housing may be provided with two rectangular openings for receiving the insulating shroud of connectors which receive in socket parts thereof the terminal ends of the contact members within the housing.

DESCRIPTION OF THE DRAWINGS

By way of example an embodiment of the invention will now be described with reference to the accompanying drawings in which:

FIGS. 2–4 is a front view of the switch of FIG. 1 with one housing part removed to show various positions of the operating cam;

FIG. 5 is a cross-sectional view of the switch of FIG. 2 taken along the lines 5—5 of FIG. 2.

TECHNICAL DESCRIPTION OF THE INVENTION

Figure 1:
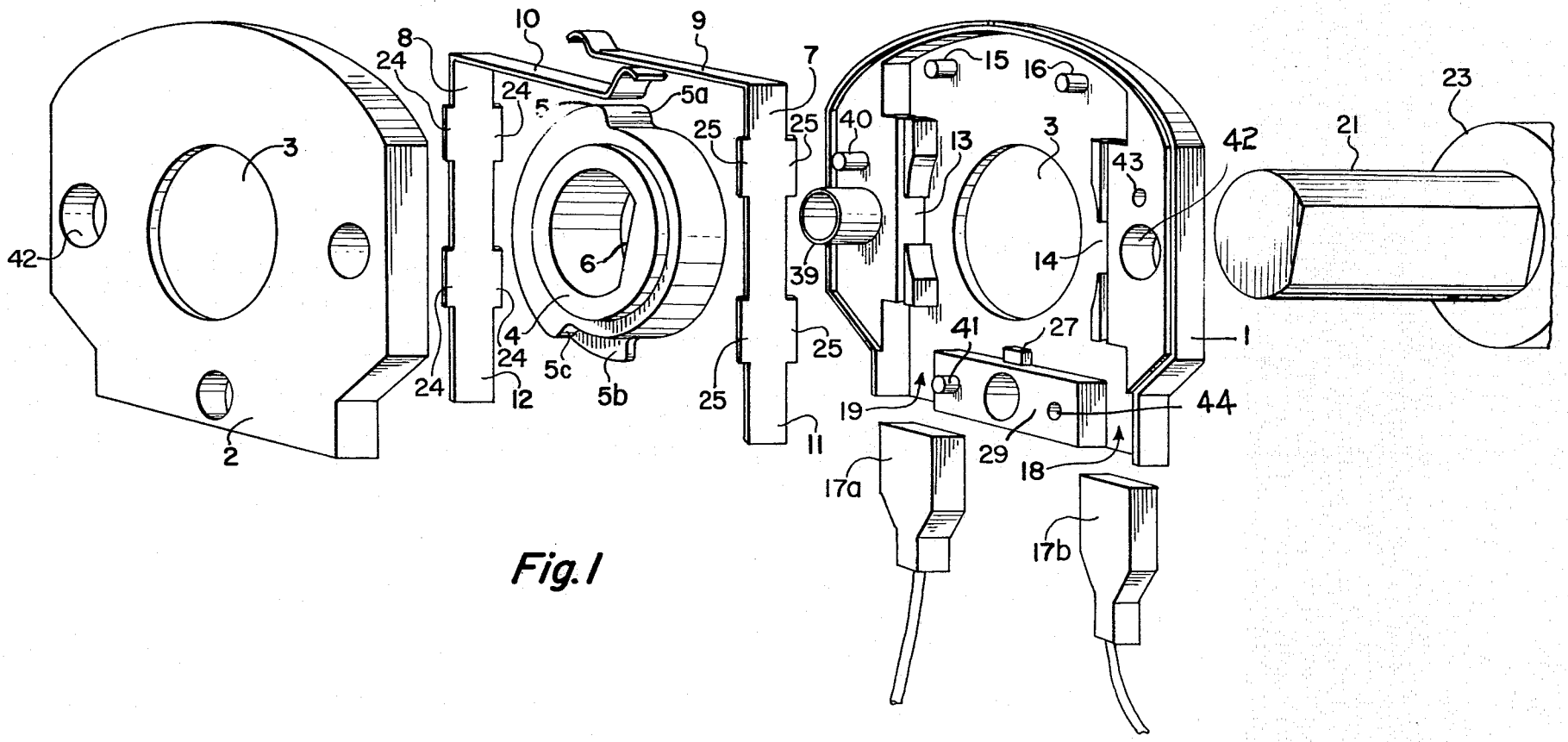
FIG. 1 shows an exploded view of an electric switch in accordance with the present invention.
Figure 6:
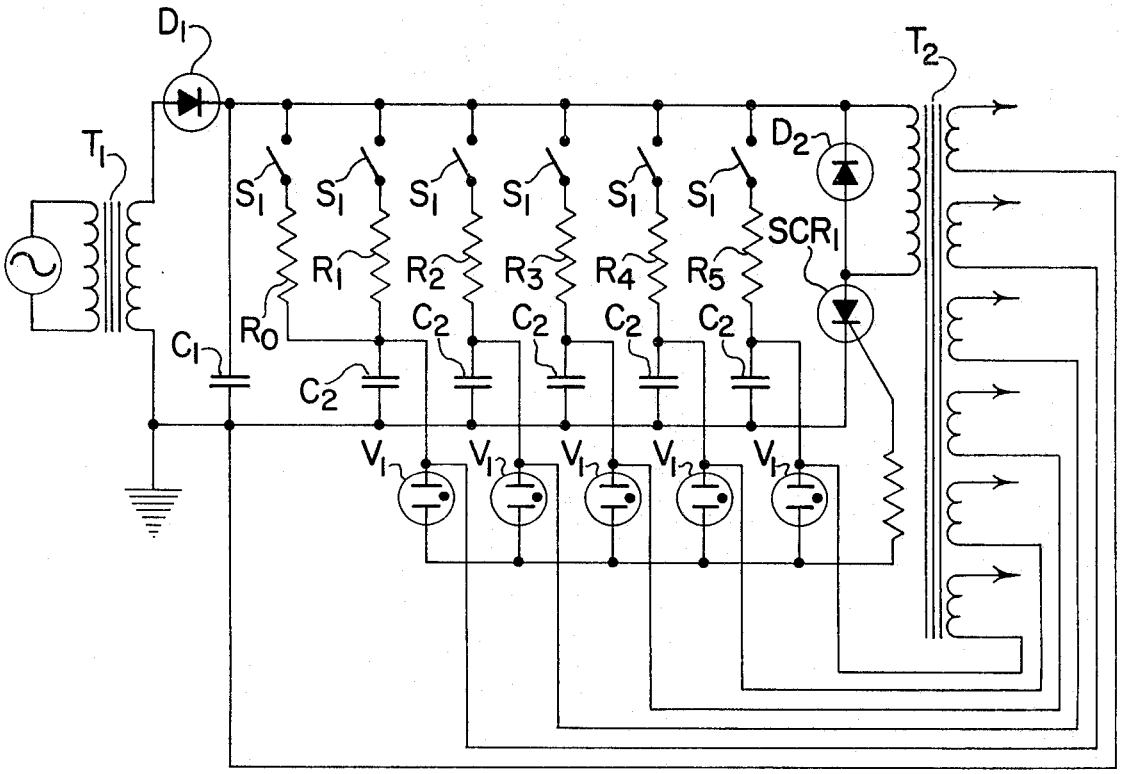
FIG. 6 is a circuit diagram of a gas reigniter system for gas cookers including a number of switches according to FIG. 1.

Referring to FIG. 1 of the drawings the switch illustrated is intended for use in a gas cooker and is adapted to be secured by screws to a gas tap assembly so that the gas tap control spindle extends through the switch housing. As can be seen from FIG. 1, the switch comprises a plastic molded housing comprising two identical housing parts 1 and 2. This housing is molded with an opening 3 extending therethrough which accommodates a rotatable cam 4 having a peripheral cam surface 5 and a segmental portion 6 which is cooperable with a flat portion of the D-shaped gas tap spindle 21 of gas valve 23 for rotatably locking the cam 4 to such spindle.

The cam surface 5 in response to rotation of the tap spindle actuates contact member 8 which makes electrical contact with another contact member 7. These contact members 7 and 8 are formed from strip metal such as beryllium copper or phosphor bronze which has been milled to afford thin flexible parts which define contact parts 9 and 10 and relatively thick rigid parts providing terminal parts 11 and 12 which are received in slots 13 and 14 of the molded housing. The contact part passes below the molded stud 15 while the contact part 7 passes above the molded stud 16 of the housing parts. The contacts 7 and 8 are held in the slots 13 and 14 by the spaced-apart protrusions 24 on the terminal part 12 and the protrusions 25 on the terminal part 11.

The cam 4 is able to rotate only about approximately 180° of rotation. This is accomplished by use of a stop member 27 on a block 29 that is integrally formed on the housing part 1 and a fin-like segment $5_b$ which acts as an extension of the cam surface 5. The segment $5_b$ is substantially narrower than the cam surface 5 and preferably is located in the center of the surface 5, as shown in FIG. 5. The surface $5_c$ of the cam contacts the surface 33 of the stop member 27 when the cam 4 is in the position shown in FIG. 2 with the segment $5_b$ passing in front of the stop member 27.

When the cam 4 is in the position shown in FIG. 2, and for as long as the extension segment $5_b$ of the cam 4 is adjacent the stop member 27, the contacts 7 and 8 will remain open since the cam surface 5 will not be in contact with the contact 8. When the cam 4 is rotated further and the extension segment $5_b$ is rotated away from the stop member 27 far enough so that the end 31 of the segment $5_b$ clears the surface 33 of the stop member 27, the cam surface 5 comes into contact with the contact 8 forcing it upward so as to make contact with the contact 7, as shown in FIG. 3. The circuit thus will stay closed until the edge $5_a$ of the cam 4 engages the surface 37 of the stop member 27. The switch will remain closed as the cam 4 is rotated in the opposite direction until the end 31 of the segment $5_b$ is again adjacent the surface 33 of the stop member 27, at which time the cam surface 5 will no longer make contact with the contact 7, thereby allowing it to spring back to its normal position and thus opening the circuit between the contacts 7 and 8. Continued rotation of the cam 4 in the reverse direction is limited as previously mentioned by the engagement of the surface $5_c$ of the cam 4 with the surface 33 of the stop member 27.

The housing parts 1 and 2 are positioned by means of the post 39, 40 and 41 which are integrally molded on the housing parts 1 and 2 and which fit into corresponding holes 42, 43 and 44 in the other housing member. The holes 43 and 44 are preferably blind holes while the holes preferably run through the housing parts 1 and 2.

For making electrical connection to the switch contact members two connectors, the insulating shrouds $17_a$, $17_b$ are pushed into openings 18 and 19 respectively, in the bottom of the switch housing so that the bottom ends of the terminal parts 11 and 12 engage with socket members of the connectors.

From the description so far it will be appreciated that the switch according to the invention is of extremely simple construction providing a molded plastic housing formed from two identical parts and the contacts of the switch also being made from the same milled strip material. Additionally, the small overall depth or thickness of the housing allows the switch to be readily accommodated against an abutment surface behind the usual front control panel of a cooker.

It may here be mentioned that in alternative constructions of the switch, the cam may be provided with an axially extending peg which is received by a hole in the gas tap knob instead of the cam having a segmental part for cooperation with a spindle flat portion. Additionally, the two housing parts may have flanges where the molded parts come together so as to prevent significant ingress of water.

In FIG. 2 of the drawings there is shown a circuit arrangement for producing reignition of gas burners of a gas cooker in the event of flame failure. In this arrangement main alternating voltage is supplied to the primary of a transformer T1 the secondary output from which charges a capacitor C1 through a diode D1. The capacitor C1 is charged up and consequent upon the operation of one of the switches S1 which in the present example will be of the form shown in FIG. 1 and which will be mounted on the spindle of respective will depending on the resistance of the appertaining secondary winding circuit of the transformer T2 connected thereto. The resistance of this secondary winding circuit will depend on whether the burner with which the circuit is associated is in the ignited condition since the circuit will include the spark gap in the flame path. If the burner is ignited, then the resistance of this circuit will be relatively low and thus the voltage at the junction of the resistor R2 and capacitor C2 and also the voltage across the associated neon V1 will be insufficient to cause the neon to break down. Thus, the primary of the transformer T2 is not pulsed in response to conduction of the thyristor SCR1. If, however, the flame is extinguished at the gas burner concerned, then the resistance of the associated secondary winding circuit of the transformer T2 will be relatively high and thus the voltage across the neon V1 will be high enough to cause the neon to break down so that the thyristor SCR1 is triggered by the consequent voltage supplied to it through the neon. Triggering of SCR1 pulses are supplied to the primary of the transformer T2 and the secondary circuit concerned will be pulsed to produce reignition of the extinguished flame. As soon as reignition is reestablished, the voltage across the neon V1 will again be reduced due to the drop in the resistance of the secondary circuit concerned and thus the triggering voltage will be removed from the thyristor SCR1 to terminate ignition pulsing of the secondary circuit.

As will be appreciated from the description appertaining to FIGS. 1 and 2 of the drawings, the switch contacts S1 will be closed when the gas tap is operated and by these contacts being made they prepare the reignition circuit in contacts or change-over contacts in other circuit configurations and switch constructions could alternatively be employed.

The invention is claimed as follows:

1. A switch for selective ignition of gas from a gas tap assembly having a rotatable gas tap spindle comprising first and second housing members which are securable together and which have a central aperture therethrough that receives said gas tap spindle therein, a rotatable cam having a cam member with a cam surface thereon, a central aperture in said rotatable cam for receiving said gas tap spindle, a locking means for locking said cam onto said gas tap spindle, and an extension segment in said rotatable cam narrower than said cam surface, first and second L-shaped contact members each having a terminal portion and a contact portion, the contact portion of one of said contact members being positioned to overlie the contact portion of said other contact member and both of said contact members being disposed to overlie said cam so that said cam surface and extension segment control the position of the lower contact portion with respect to the upper contact portion, and a stop member on one of said housing members for limiting rotation of said cam of a width which allows said extension segment to rotate past said stop member for a limited portion of the rotation of said cam during which said contact members are disengaged, with said cam surface being of a length such that said contacts are in engagement over substantially the remaining portion of rotation of said cam between its two extreme positions of rotation.

2. A switch as set forth in claim 1 wherein said first and second housing members constructed to form first and second openings into which said terminal portions of said first and second contact members project and a pair of insulated sockets are each positioned in one of said openings to receive one of said terminal portions and so that said contact members and said cam are retained in said housing without the use of additional securing means when said first and second housing members are secured together.

3. A switch as claimed in claim 1 wherein one of said housing members has first and second slots for holding said terminal portions of said first and second contact members in place in said housing.

4. A switch as claimed in claim 1 wherein first and second studs are molded into said housing so that one stud is over one of said contact portions and the other stud is under the other of said contact portions.

5. A switch as set forth in claim 1 wherein said terminal portions of said contact members are relatively thicker than said contact portions of said contact members.

6. A switch as set forth in claim 5 wherein said first and second housing members constructed to form first and second openings into which said terminal portions of said first and second contact members project and a pair of insulated sockets are each positioned in one of said openings to receive one of said terminal portions and so that said contact members and said cam are retained in said housing without the use of additional securing means when said first and second housing members are secured together.

7. A switch as claimed in claim 6 wherein one of said housing members has first and second slots for holding said terminal portions of said first and second contact members in place in said housing.

8. A switch as claimed in claim 7 wherein first and second studs are molded into said housing so that one stud is over one of said contact portions and the other stud is under the other of said contact portions.

* * * * *